US006710694B2

(12) United States Patent
Matsuta et al.

(10) Patent No.: US 6,710,694 B2
(45) Date of Patent: Mar. 23, 2004

(54) COIL DEVICE

(75) Inventors: Katsuji Matsuta, Yokohama (JP); Kenichi Ito, Sagamihara (JP); Masahiko Kawaguchi, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/271,751

(22) Filed: Oct. 17, 2002

(65) Prior Publication Data

US 2003/0076211 A1 Apr. 24, 2003

(30) Foreign Application Priority Data

Oct. 23, 2001 (JP) ..... 2001-324930

(51) Int. Cl.[7] ..... H01F 5/00
(52) U.S. Cl. ..... 336/200; 336/232; 336/223
(58) Field of Search ..... 336/200, 223, 336/232

(56) References Cited

U.S. PATENT DOCUMENTS 5,250,923 A * 10/1993 Ushiro et al. ..... 336/83
5,552,756 A * 9/1996 Ushiro ..... 336/200
5,850,682 A * 12/1998 Ushiro ..... 29/608
6,448,879 B1 * 9/2002 Kitamura ..... 336/200
6,515,568 B1 * 2/2003 Maki et al. ..... 336/200
6,593,841 B1 * 7/2003 Mizoguchi et al. ..... 336/200
6,618,929 B2 * 9/2003 Kitamura ..... 29/602.1

FOREIGN PATENT DOCUMENTS

JP 08-203737 8/1996
JP 11-054326 2/1999

* cited by examiner

*Primary Examiner*—Anh Mai
(74) *Attorney, Agent, or Firm*—Keating & Bennett, LLP

(57) ABSTRACT

A coil device includes a first magnetic substrate, a laminated body disposed on the first magnetic substrate and having insulating layers, coil patterns, and at least one through-hole, a magnetic layer covering the upper surface of the laminated body, an adhesive layer disposed on the magnetic layer, and a second magnetic substrate disposed on the adhesive layer and bonded to the magnetic layer via the adhesive layer. The insulating layers defining an insulator and the coil patterns for forming a coil are alternately stacked so that the coil patterns are arranged in the insulator, the through-hole is located at an area where the coils are not located and extends from the upper surface of the laminated body to the first magnetic substrate. The magnetic layer has at least one portion extending through the through-hole to contact the first magnetic substrate. The adhesive layer is nonmagnetic, and the laminated body is sandwiched between the first and second substrates.

9 Claims, 8 Drawing Sheets

COIL DEVICE

BACKGROUND OF THE INVENTION

1. Field of the Invention

The present invention relates to coil devices, and particularly relates to a coil device such as a transformer and a common-mode choke coil.

2. Description of the Related Art

Conventional coil devices includes a coil device (conventional art 1) shown in FIGS. 7A and 7B, and such a coil device is disclosed in Japanese Unexamined Patent Application Publication No. 8-203737. This coil device is a surface mounted type and is for high frequency use. The coil device has a laminated body 51 including an insulator, in which two spiral coils 52 and 53, magnetic substrates 54 and 55, and external electrodes 56 and 57 are arranged. The spiral coils 52 and 53 face each other with a portion of the insulator disposed therebetween, are sandwiched between the magnetic substrates 54 and 55, and are connected to external electrodes. In FIG. 7B, only the spiral coil 52 is connected to the external electrodes 56 and 57. This coil device has various characteristics including compactness, low profile, better high-frequency properties than a laminated body having a ferrite element assembly in which coils are arranged, no difference in inductance caused by a difference in the relative magnetic permeability, and good coupling between coils in a common-mode choke coil.

Another coil device (conventional art 2) having a configuration shown in FIG. 8 is disclosed in Japanese Unexamined Patent Application Publication No. 11-54326. This coil device has upper and lower magnetic substrates 54 and 55, two spiral coils 52 and 53, a laminated body (layered region) 51 having a ring shape, and an adhesive layer (magnetic layer) 58 having a relative magnetic permeability of 1 or more, wherein the laminated body 51 contains the spiral coils 52 and 53 therein and is disposed on the lower magnetic substrates 54, and the adhesive layer 58 is disposed between the upper and lower magnetic substrates 54 and 55.

In this coil device, since the laminated body 51 disposed on the lower magnetic substrate 54 is covered with the adhesive layer 58 having a relative permeability of 1 or more, the lines of magnetic force generated by the spiral coils 52 and 53 form closed magnetic circuits, as shown in FIG. 8. The adhesive layer 58 and an insulator other than a region where coil patterns are located include a material having a relative permeability of 1 or more, and therefore, the degree of electromagnetic coupling between the spiral coils 52 and 53 is increased. Thus, a large inductance can be obtained.

However, in the coil device of the conventional art 1 disclosed in Japanese Unexamined Patent Application Publication No. 8-203737, there is a problem in that a large inductance and miniaturization cannot be achieved simultaneously because the adjustable range of the inductance is limited.

On the other hand, in the coil device of the conventional art 2 disclosed in Japanese Unexamined Patent Application Publication No. 11-54326, the adhesive layer 58 having a relative permeability of 1 or more covers the laminated body 51 disposed on the lower magnetic substrate 54 to increase the inductance. In order to prepare an adhesive layer having a relative permeability of 1 or more, the adhesive layer must include an adhesive material and a magnetic material. In order to obtain a larger relative permeability, the magnetic material content must be very high. However, there is a maximum magnetic material content when the adhesive layer is to have a large relative permeability and a predetermined adhesive force in combination. Therefore, there is a problem in that the product reliability is decreased when the magnetic material content exceeds the maximum value.

Since layered coils are disposed in the adhesive layer having a relative permeability of 1 or more, the inductance is increased in proportion to an increase in the relative permeability of the magnetic layer. There is a problem in that a difference in the relative permeability in the magnetic layer has a strong effect on the inductance.

SUMMARY OF THE INVENTION

In order to solve the above-described problems, preferred embodiments of the present invention provide a coil device in which miniaturization and a large inductance are achieved simultaneously, and which has high reliability.

A coil device according to a preferred embodiment of the present invention includes a first magnetic substrate, a laminated body disposed on the first magnetic substrate and including insulating layers, coil patterns, and at least one through-hole, a magnetic layer covering the upper surface of the laminated body, an adhesive layer disposed on the magnetic layer, and a second magnetic substrate disposed on the adhesive layer and bonded to the magnetic layer with the adhesive layer, wherein the insulating layers define an insulator and the coil patterns for defining coils are stacked so that the coils are disposed in the insulator, the at least one through-hole is located at an area where the coils are not located and extends from the upper surface of the laminated body to the first magnetic substrate, the magnetic layer has at least one portion extending through the at least one through-hole to contact the first magnetic substrate, the adhesive layer is nonmagnetic, and the laminated body is sandwiched between the first and second substrates.

In the above-described coil device, the at least one through-hole is located at an area where the coils are not located in the laminated body and extends from the upper surface of the laminated body to the first magnetic substrate, the magnetic layer is disposed on the laminated body, and the magnetic layer has a portion extending through the through-hole to contact the first magnetic substrate. Therefore, a large impedance can be obtained without increasing the coil device size and the magnetic layer is securely joined to the second magnetic substrate with the nonmagnetic adhesive layer located therebetween. Since a very thin adhesive layer is disposed between the magnetic layer and the second magnetic substrate and functions as a nonmagnetic zone, stable inductance characteristics in a higher frequency band can be obtained as compared with a configuration in which a magnetic layer directly contacts the second magnetic substrate.

Usually, it is difficult to reduce the difference in relative permeability of magnetic bodies to the range of approximately −30% to approximately 30%. In a configuration having perfect closed magnetic circuits, the difference in relative permeability of magnetic bodies has a strong effect on the electrical characteristics. However, in the coil device of the present preferred embodiment, the inductance and the impedance are only slightly changed depending on the difference in relative permeability of the magnetic substrates and the magnetic layer. Therefore, the coil device has high accuracy due to a small difference in the characteristics.

In a preferred embodiment of the present invention, the coil device preferably functions as a common-mode choke coil having a configuration in which a plurality of the coils are arranged to face one another in the laminated body with each of the insulating layers being disposed therebetween, and the main portion of each coil and each insulating layer are alternately stacked. The main portion of each coil includes an area except for portions for connecting to the terminal electrodes of the coil.

In this coil device, since the common-mode choke coil has the above-described configuration, a magnetic flux is allowed to converge in the magnetic substrates and the magnetic layer. Since the common magnetic flux generated between a pair of coils facing each other can be increased compared with conventional common-mode choke coils, the degree of coupling between the coils can be increased. Thus, for the electrical characteristics, the impedance in a differential mode can be decreased, thereby reducing the influence on the transmitted waveform.

In the coil device of a preferred embodiment of the present invention, the coils are preferably spiral-shaped and preferably have the through-hole located at the approximate center of each coil.

Since the coils have the above-described configuration and the through-hole extends from the upper surface of the laminated body to the first magnetic substrate, closed magnetic circuits extending from substantially the centers of the coils to the peripheries thereof and further extending to the approximate centers are provided. Thus, when the coil device functions as a common-mode choke coil having a plurality of coils, the degree of coupling between the coils can be increased and a large impedance can be obtained.

In the coil device of a preferred embodiment of the present invention, the coils and/or the insulating layers are preferably formed by a photolithography method.

Since the coils and/or the insulating layers are formed in the above manner, the coils are very fine, thin, and precise. Thus, small high-performance coil devices efficiently providing inductance and impedance can be obtained.

In the coil device of a preferred embodiment of the present invention, the magnetic layer disposed between the first and second magnetic substrates preferably has a relative permeability of about 2 to about 7.

Since the magnetic layer has a relative permeability of about 2 to about 7, the coil device efficiently provides a large inductance and impedance.

When the magnetic layer has a relative permeability of less than 2, the desired inductance cannot be obtained and changes in inductance are increased depending on the difference in relative permeability. In contrast, when the magnetic layer has a relative permeability of more than 7, the inductance can be increased but the magnetic layer cannot have the required adhesiveness because the magnetic material content (magnetic powder content), for example, the magnetic material content in a resin compound, must be significantly increased.

In the coil device of a preferred embodiment of the present invention, the distance between the first and second magnetic substrates is preferably about 70 $\mu$m or less, and the adhesive layer preferably has a thickness of about 1 $\mu$m to about 5 $\mu$m.

When the distance exceeds about 70 $\mu$m, the desired inductance cannot be obtained.

When the thickness of the adhesive layer is less than about 1 $\mu$m, a large inductance can be obtained but there is a risk that poor adhesion arises because an adhesive layer having such a small thickness cannot accommodate the surface roughness of the laminated body and the magnetic layer. Furthermore, differences in the characteristics are increased depending on changes in the thickness. When the thickness of the adhesive layer is more than about 5 $\mu$m, a large adhesive force can be obtained but the inductance is decreased and therefore the effects obtained from the configuration according to preferred embodiments of the present invention are decreased.

In the coil device of various preferred embodiments of the present invention, the magnetic layer and the adhesive layer preferably have a cavity therebetween and the cavity is located at an area substantially corresponding to the through-hole formed in the laminated body in plan view.

Since the cavity is a recessed portion in the magnetic layer and is located between the magnetic layer and the adhesive layer, the volume ratio of the magnetic layer in the laminated body is decreased, thereby reducing changes in the inductance depending on the difference in relative permeability of the magnetic layer or the difference in the state of the magnetic layer portion extending through the through-hole of the laminated body. Therefore, the desired inductance and impedance can be obtained with high accuracy.

In the coil device of a preferred embodiment of the present invention, the depth of the cavity is about 0.2A to about 0.6A, where A represents the distance between the upper surface of the first magnetic substrate and the lower surface of the adhesive layer, wherein the lower surface is an area where the cavity is not located in the upper surface of the magnetic layer.

Since the cavity has such a depth, changes in inductance are small, thereby reducing the difference in inductance.

When the cavity has a depth of less than about 0.2A, the difference in inductance is increased depending on the processing accuracy. When the cavity has a depth of more than about 0.6A, the desired inductance cannot be obtained efficiently.

A coil device according to a preferred embodiment of the present invention includes a first magnetic substrate, a laminated body disposed on the first magnetic substrate and including insulating layers, coils, and at least one through-hole, a magnetic layer covering the upper surface of the laminated body, an adhesive layer disposed on the magnetic layer, a cavity located at an area between the magnetic layer and the adhesive layer, the area substantially corresponding to the through-hole, and a second magnetic substrate disposed on the adhesive layer and bonded to the magnetic layer with the adhesive layer, wherein the insulating layers define an insulator and the coil patterns for forming coils are stacked so that the coils are disposed in the insulator, the at least one through-hole is located at substantially the center of the coils and extends from the upper surface of the laminated body to the first magnetic substrate, the magnetic layer has at least one portion extending through the through-hole to contact the first magnetic substrate and has a relative permeability of about 2 to about 7, the adhesive layer is nonmagnetic, and the laminated body is sandwiched between the first and second substrates.

Other features, elements, characteristics and advantages of the present invention will become more apparent from the following detailed description of preferred embodiments thereof with reference to the attached drawings.

BRIEF DESCRIPTION OF THE DRAWINGS

FIGS. 7A and 7B are illustrations showing a conventional common-mode choke coil, wherein FIG. 7A is an exploded perspective view showing the main portions thereof, and FIG. 7B is a sectional view thereof.

DETAILED DESCRIPTION OF PREFERRED EMBODIMENTS

The present invention will now be described in detail with respect to preferred embodiments thereof.

A first preferred embodiment of a coil device of the present invention is described using a common-mode choke coil as an example.

Figure 1:
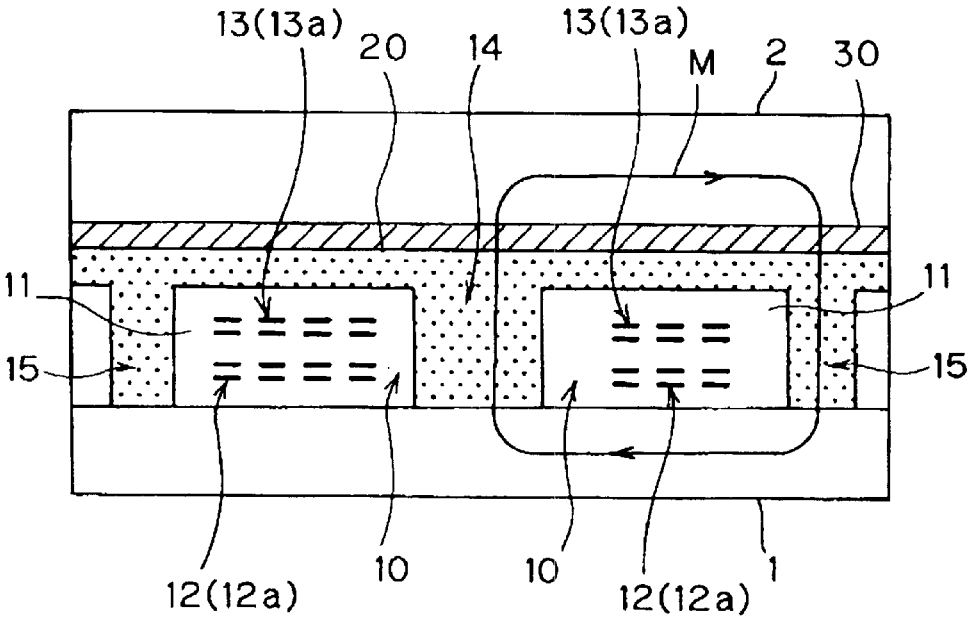
FIG. 1 is a sectional view showing a common-mode choke coil (coil device) according to a preferred embodiment of the present invention.
Figure 2:
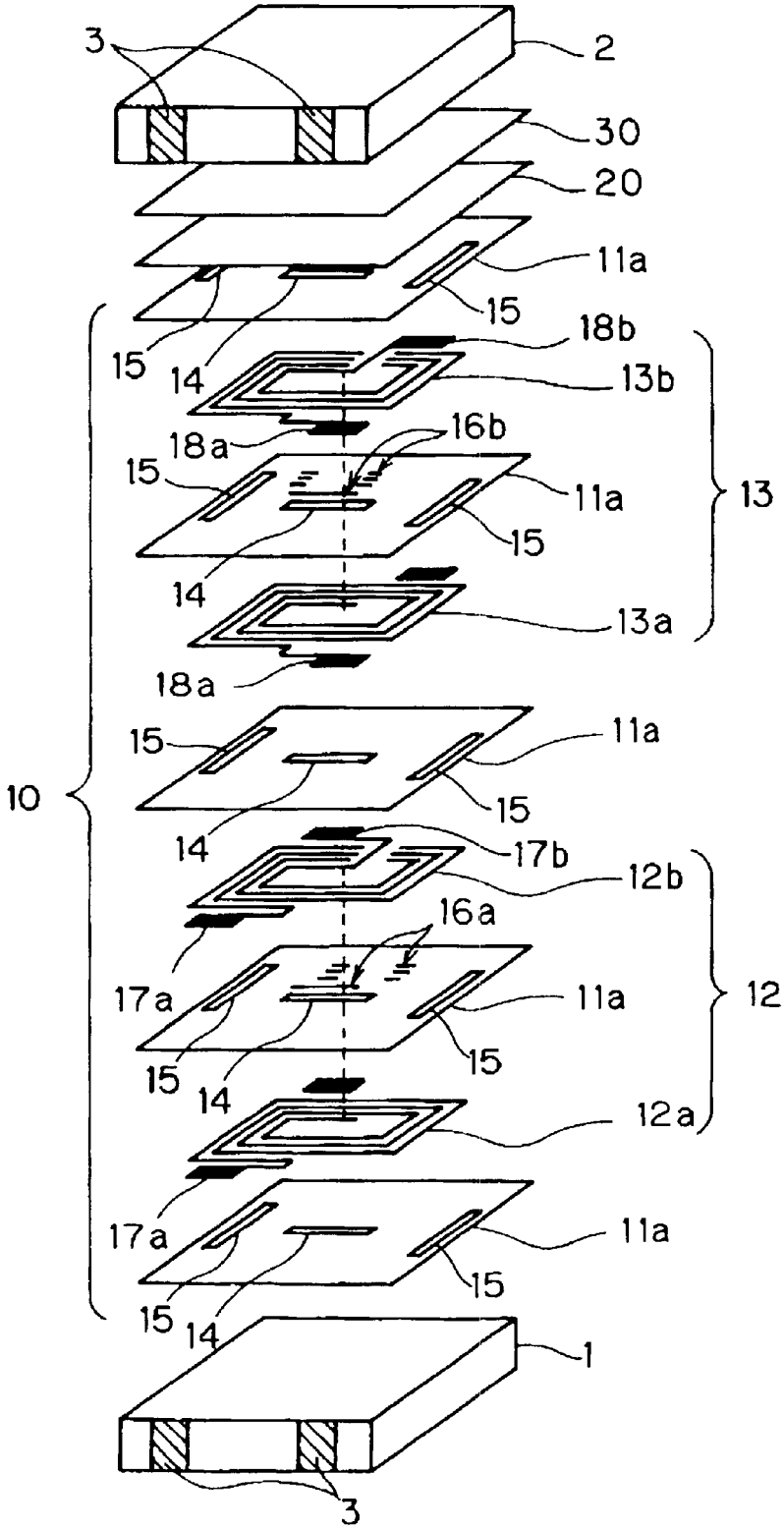
FIG. 2 is an exploded perspective view showing the main portions of a common-mode choke coil (coil device) according to a preferred embodiment of the present invention.

FIG. 1 is a sectional view showing a common-mode choke coil (coil device) according to a first preferred embodiment of the present invention. FIG. 2 is an exploded sectional view showing the main components thereof.

As shown in FIGS. 1 and 2, the common-mode choke coil preferably includes a first magnetic substrate 1, a laminated body 10 disposed on the first magnetic substrate and having an insulator 11 and first and second coils 12 and 13 therein, a magnetic layer 20 covering the upper surface of the laminated body 10, an adhesive layer 30 disposed on the magnetic layer 20, and a second magnetic substrate 2 disposed on the adhesive layer and bonded to the magnetic layer 20 with the adhesive layer 30 located therebetween. In this configuration, the first and second coils 12 and 13 having a spiral shape are electrically insulated from each other via the insulator 11, the adhesive layer 30 is nonmagnetic, and the adhesive layer 30, the magnetic layer 20, and the laminated body 10 are arranged in that order between the first and second magnetic substrates 1 and 2, respectively.

As shown in FIG. 2, the common-mode choke coil further includes terminal electrodes (external electrodes) 3, the first coil 12 includes a first input side lead electrode 17*a* and a first output side lead electrode 17*b*, and the second coil 13 includes second input side lead electrode 18*a* and a second output side lead electrode 18*b*. The terminal electrodes 3 are connected to the first input side lead electrode 17*a*, the first output side lead electrode 17*b*, the second input side lead electrode 18*a*, and the second output side lead electrode 18*b*. FIG. 2 shows the terminal electrodes 3 disposed at an end surface at the front of the coil device.

The insulator 11 includes a plurality of insulating layers 11*a*. The first coil 12 preferably has two first coil patterns 12*a* and 12*b*, and the second coil 13 preferably has second coil patterns 13*a* and 13*b*. The laminated body 10 disposed on the first magnetic substrate 1 has a configuration in which the insulating layers 11*a*, the first coil patterns 12*a* and 12*b*, and the second coil patterns 13*a* and 13*b* are stacked in such a manner that each of the insulating layers 11*a* is disposed between the first and second coil patterns 12*a*, 12*b*, 13*a*, and 13*b*. The first and second coils 12 and 13 are arranged in the insulator 11. In the laminated body 10, at an area where the first and second coil patterns 12*a*, 12*b*, 13*a*, and 13*b* are not located, that is, at substantially the center portions of the first and second coils 12 and 13 in this preferred embodiment, a first through-hole (hole used for forming magnetic circuits) 14 extends from the upper surface of the laminated body 10 to the first magnetic substrate 1. At the peripheral portions of the first and second coils 12 and 13, second through-holes (holes used for forming magnetic circuits) 15 extend from the upper surface of the laminated body 10 to the first magnetic substrate 1. Thus, as shown in FIG. 1, a closed magnetic circuit M is formed.

The first coil patterns 12*a* and 12*b* of the first coil 12 define a double layer having one of the insulating layers 11*a* therein and have substantially the same pattern as each other except for portions connected to the terminal electrodes 3. The second coil patterns 13*a* and 13*b* of the first coil 13 also define a double layer having one of the insulating layers 11*a* therein and have substantially the same pattern as each other except for portions connected to the terminal electrodes 3. That is, each of the first coil patterns 12*a* and 12*b* and each of the second coil patterns 13*a* and 13*b* have substantially the same pattern as each other, and the first coil 12 and the second coil 13 have one of the insulating layers 11*a* disposed therebetween. First via holes 16*a* are located between the first coil patterns 12*a* and 12*b*, thereby connecting the first coil patterns 12*a* and 12*b* with the first via holes 16*a*. Thus, the first coil 12 has a configuration in which the first coil patterns 12*a* and 12*b* defining a double layer are arranged close together and are connected in parallel. Second via holes 16*b* are located between the second coil patterns 13*a* and 13*b*, thereby connecting the second coil patterns 13*a* and 13*b* with the second via holes 16*b*. Thus, the second coil 13 has a configuration in which the second coil patterns 13*a* and 13*b* defining a double layer are arranged close together and are connected in parallel.

As a result, the coil line of the first coil 12 has a cross-sectional area that is approximately two times larger than that of each of the first coil patterns 12*a* and 12*b*. The coil line of the second coil 13 has a cross-sectional area that is approximately two times larger than that of each of the second coil patterns 13*a* and 13*b*. Therefore, the resistance can be decreased. Since each of the first coil patterns 12*a* and 12*b* and each of the second coil patterns 13*a* and 13*b* have substantially the same shape as each other and are stacked, the upper surface and the lower surface of the laminated body 10 are flat, that is, there are no irregular portions on the upper and lower surfaces. Therefore, the laminated body 10 is securely joined to the first and second magnetic substrates 1 and 2.

Since the first coil patterns 12*a* and 12*b* and the second coil patterns 13*a* and 13*b* are arranged close together, the first coil patterns 12*a* and 12*b* and the second coil patterns 13*a* and 13*b* are securely coupled, thereby preventing the inductance from decreasing. It is preferable that each of insulating layers 11*a* located between the first coil patterns 12*a* and 12*b*, between the second coil patterns 13*a* and 13*b*, and between the first and second coils 12 and 13 have a thickness of about 1 μm to about 3 μm.

The number of the insulating layers 11*a* disposed between various portions is not limited. One may be disposed therebetween, as shown in FIG. 2, or a plurality of the insulating layers 11*a* may be disposed therebetween. The thicknesses of the insulating layers 11*a* may be different or they may be the same.

The first coil 12 and the second coil 13 may include two or more coil patterns or a single coil pattern.

In the common-mode choke coil of this preferred embodiment, the magnetic layer 20 covering the laminated body 10 has portions extending through the first and second through-holes 14 and 15 so as to contact the first magnetic substrate 1. In this preferred embodiment, in order to reliably provide magnetic circuits, the first through-hole 14 extends from substantially the center of the first coil 12 to substantially the center of the second coil 13 and the second through-holes 15 extend from the peripheries of the first coil 12 to the peripheries of the second coil 13, thereby allowing each portion of the magnetic layer 20 to extend through the first and second through-holes 14 and 15. It is possible to form magnetic circuits in practice using only the first through-hole 14 extending from substantially the center of the first coil 12 to substantially the center of the second coil 13.

In this preferred embodiment, the magnetic layer 20 preferably includes a magnetic material having approximately 60%–70% by volume of fine ferrite powder and approximately 30–40% by volume of a polyimide resin. Since the magnetic material includes the fine ferrite powder and the polyimide resin, the magnetic layer 20 has high heat resistance and strong adhesion to the insulating layers 11*a*.

In this preferred embodiment, the adhesive layer 30 occupies substantially the entire area between the magnetic layer 20 and the second magnetic substrate 2. However, the adhesive layer 30 need not be disposed on substantially the entire area between the magnetic layer 20 and the second magnetic substrate 2. Instead, it may be partially disposed on only a portion of that area. That is, for example, the adhesive layer 30 may be disposed at an area corresponding to the periphery of the second magnetic substrate 2, or some portions of the adhesive layer 30 may be arranged so as to form dots.

The ferrite powder is preferably very fine so as not to cause damage to the laminated body 10 and preferably has a maximum particle diameter of about 3 μm or less. The resin is not limited to polyimide and instead, various resins can be used. Furthermore, glass may be used.

The nonmagnetic adhesive layer 30 disposed on the magnetic layer 20 has a function of joining the magnetic layer 20 to the second magnetic substrate 2 and also functions as a nonmagnetic zone between the magnetic layer 20 and the second magnetic substrate 2. Such a configuration provides stable inductance characteristics at high frequencies compared with a configuration in which the magnetic layer 20 is directly joined to the second magnetic substrate 2. In this preferred embodiment, the adhesive layer 30 preferably includes a thermoplastic polyimide resin.

The first and second magnetic substrates 1 and 2 sandwich the magnetic layer 20 and the laminated body 10 having the two first and second coils 12 and 13 therein. In this preferred embodiment, the first and second magnetic substrates 1 and 2 preferably include ferrite having superior high-frequency properties. In order to avoid obstruction when each component is formed, the first and second magnetic substrates 1 and 2 are preferably polished by a photolithography method so as to have a surface roughness Ra of about 0.5 μm or less.

Electrode materials for the first coil patterns 12*a* and 12*b*, the second coil patterns 13*a* and 13*b*, the first input side lead electrode 17*a*, the first output side lead electrode 17*b*, the second input side lead electrode 18*a*, and the second outer-end lead electrode 18*b*, preferably include metal such as Ag, Pd, Cu, Al, and alloys thereof, which have high conductivity, or other suitable material. In this preferred embodiment, the above components are preferably made of at least Ag.

The insulating layers 11*a* may include various resins such as a polyimide resin, an epoxy resin, and a benzocyclobutene resin, glass, and ceramics such as $SiO_2$, or other suitable materials. When a photolithography method is used for processing, the insulating layers 11*a* preferably include a photosensitive material. The above-described materials can be used for the insulating layers 11*a* in combination depending on the application. In this preferred embodiment, the insulating layers 11*a* preferably include a photosensitive polyimide resin, which is an insulating material.

It is preferable to determine the combination of the electrode material used for the coils and so on and the insulating material used for the insulating layers 11*a* in consideration of the processability and the adhesiveness.

A method for manufacturing a common-mode choke coil having the above configuration will now be described.

Usually, a plurality of common-mode choke coils are simultaneously manufactured according to the following procedure: a plurality of devices are formed on a mother substrate and the resulting mother substrate is cut into a plurality of common-mode choke coils. In the following description, an example method for manufacturing a single common-mode choke coil is illustrated.

(1) The insulating layers 11*a* and electrode layers are stacked on the first magnetic substrate 1 to form the laminated body 10 so as to obtain the desired first and second coils 12 and 13, wherein the electrode layers include the first coil patterns 12*a* and 12*b*, the second coil patterns 13*a* and 13*b*, the first outer-end lead electrodes 17*a*, the first output side lead electrode 17*b*, the second input side lead electrode 18*a*, and the second outer-end lead electrode 18*b*.

Before stacking, each component is processed to have the following configuration. Each insulating layer 11*a* has holes, for the first and second through-holes 14 and 15, formed by a photolithography method, wherein the first and second through-holes 14 and 15 extend from the first magnetic substrate 1 to the magnetic layer 20, which is formed in a subsequent step. These through-holes are used for forming magnetic circuits.

One of the insulating layers 11*a* has the two first coil patterns 12*a* and 12*b*, each of which is located on a surface thereof, to form the first coil 12 and has the first via holes 16*a* for electrically connecting the first coil patterns 12*a* and 12*b*. Another one of the insulating layers 11*a* includes the two second coil patterns 13*a* and 13*b*, each of which is located on a surface thereof, to form the second coil 13 and has the second via holes 16*b* for electrically connecting the second coil patterns 13*a* and 13*b*. In this preferred embodiment, as shown in FIG. 2, the second insulating layer 11*a* from the bottom has the first via holes 16*a* for connecting the first coil patterns 12*a* and 12*b*. The fourth insulating layer 11*a* from the bottom has the second via holes 16*b* for connecting the second coil patterns 13*a* and 13*b*.

As described above, the first coil patterns 12*a* and 12*b* defining a double layer are electrically connected with the first via holes 16*a* to define the first coil 12. The second coil patterns 13*a* and 13*b* defining another double layer are electrically connected with the second via holes 16*b* to define the second coil 13. Each of the outer ends of the first coil patterns 12*a* and 12*b* is connected to the first input side lead electrode 17*a*, which is extended to a first end surface of laminated body 10. Each of the outer ends of the second coil patterns 13*a* and 13*b* is connected to the second input side lead electrode 18*a*, which is extended to the first end surface of the laminated body 10. The inner end of the lower first coil pattern 12*a* is extended through one of the first via holes 16*a* and is connected to the first output side lead electrode 17*b*, which is also connected to the inner end of the upper one of the first coil patterns 12*a* and 12*b* and is extended to a second end surface of the laminated body 10 opposite to the first end surface. The inner end of the lower second coil pattern 13*a* is connected to the second output side lead electrode 18*b*, which is also connected to the inner end of the upper one of the second coil pattern 13*b* and is extended to the second end surface of the laminated body 10.

(2) A magnetic material is applied onto the upper surface of the laminated body 10 by a printing method to form the magnetic layer 20 so as to cover the upper surface of the laminated body 10 and so as to allow portions of the magnetic layer 20 to extend into the first and second through-holes 14 and 15. The magnetic material preferably includes a polyimide resin containing fine ferrite powder and has a relative permeability of approximately 2–7. In order to reliably provide the magnetic material in the first and second through-holes 14 and 15, printing and drying may be repeated two to four times. According to the above procedure, the following configuration is obtained: the laminated body 10 is sandwiched between the first magnetic substrate 1 and the magnetic layer 20, and portions of the magnetic layer 20 extend into the first and second through-holes 14 and 15 to contact the first magnetic substrate 1.

Since the magnetic layer 20 is preferably formed by a printing method, the portions of the magnetic layer 20 can be reliably provided in the first and second through-holes 14 and 15.

(3) After forming the magnetic layer 20 according to the above procedure, an adhesive material is applied, by a spin coating method, onto a surface of the second magnetic substrate 2 to form the adhesive layer 30. The adhesive material includes a thermoplastic polyimide resin. The surface having the adhesive material functions as a bonding surface in a bonding step. The adhesive layer 30 has a thickness of approximately 2–3 $\mu$m and the variation in thickness is about ±1 $\mu$m. Since the spin coating method is used, the thickness of the adhesive layer 30 can be precisely adjusted. The second magnetic substrate 2 is joined to the upper surface of the magnetic layer 20 with the adhesive layer 30 located therebetween. As a result, a joined structure in which the first magnetic substrate 1, the laminated body 10, the magnetic layer 20, the adhesive layer 30, and the second magnetic substrate 2 are arranged in that order is obtained.

In this preferred embodiment, the second magnetic substrate 2 is bonded to the magnetic layer 20 with the adhesive layer 30 located therebetween according to the following procedure: the adhesive layer 30 is formed on a surface of the second magnetic substrate 2, the adhesive layer 30 is placed on the magnetic layer 20, the magnetic layer 20 and the adhesive layer 30 joined to the second magnetic substrate 2 are heated, pressed, and cooled in an inert gas or in a vacuum, and the applied pressure is then removed therefrom.

Alternatively, an adhesive material may be provided on a surface of the second magnetic substrate 2 and a surface of the magnetic layer 20 to join both surfaces together.

In a process for manufacturing a plurality of elements by cutting a mother substrate, the joined structure in the above-described state may be cut into individual elements by a dicing method or other suitable process.

(4) Each pair of terminal electrodes 3 is formed on an end surface of each of the first and second magnetic substrates 1 and 2, wherein the terminal electrodes 3 are connected to the first input side lead electrode 17*a*, the first output side lead electrode 17*b*, the second input side lead electrode 18*a*, and the second outer-end lead electrode 18*b*. As a result, the common-mode choke coil shown in FIGS. 1 and 2 is completed.

The features and advantages of the common-mode choke coil having the above-described configuration will now be described.

As shown in FIG. 1, since the common-mode choke coil has closed magnetic circuits M, the reluctance of the coil circuits in the laminated body 10 can be decreased, thereby efficiently obtaining the desired inductance and impedance. Therefore, the miniaturization of the common-mode choke coil can be achieved.

Since the magnetic flux converges on the first and second magnetic substrates 1 and 2 and the magnetic layer to increase the common magnetic flux generated by the coils 12 and 13 facing each other, the degree of coupling between the coils 12 and 13 can be increased compared with conventional common-mode choke coils. Thus, for the electrical characteristics, the impedance in a differential mode can be decreased, thereby reducing the influence on the transmitted waveform.

The second magnetic substrate 2 is joined to the magnetic layer 20 with the adhesive layer 30. Since the adhesive layer 30, which has a very small thickness, also functions as a nonmagnetic zone, the common-mode choke coil has stable inductance characteristics at high frequencies compared with the frequency characteristics of the magnetic material. Since the inductance and the impedance slightly change depending on the difference in relative permeability of the first and second magnetic substrates 1 and 2 and the magnetic layer 20, the frequency characteristics can be improved.

Figure 3:
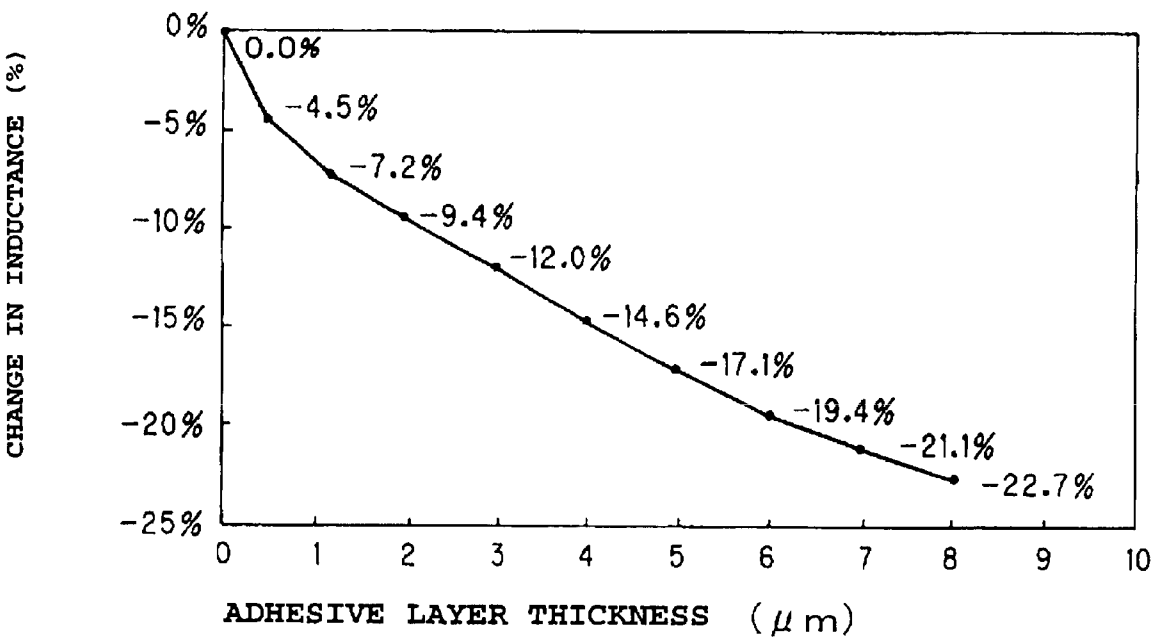
FIG. 3 is a graph showing the relationship between the adhesive layer thickness and changes in the inductance of a common-mode choke coil (coil device) according to a preferred embodiment of the present invention.

FIG. 3 shows the relationship between the adhesive layer thickness and changes in inductance. In FIG. 3, the change in inductance is 0 when the adhesive layer thickness is 0, that is, no adhesive layer is provided there.

When the thickness is less than about 1 $\mu$m, the rate of changes in inductance per unit thickness is too large and the second magnetic substrate 2 cannot be securely joined to the magnetic layer 20. Therefore, the adhesive layer thickness is preferably about 1 $\mu$m or more.

When the thickness exceeds about 5 $\mu$m, a sufficient adhesive force can be obtained but the inductance value is too small, which is not preferable.

Figure 4:
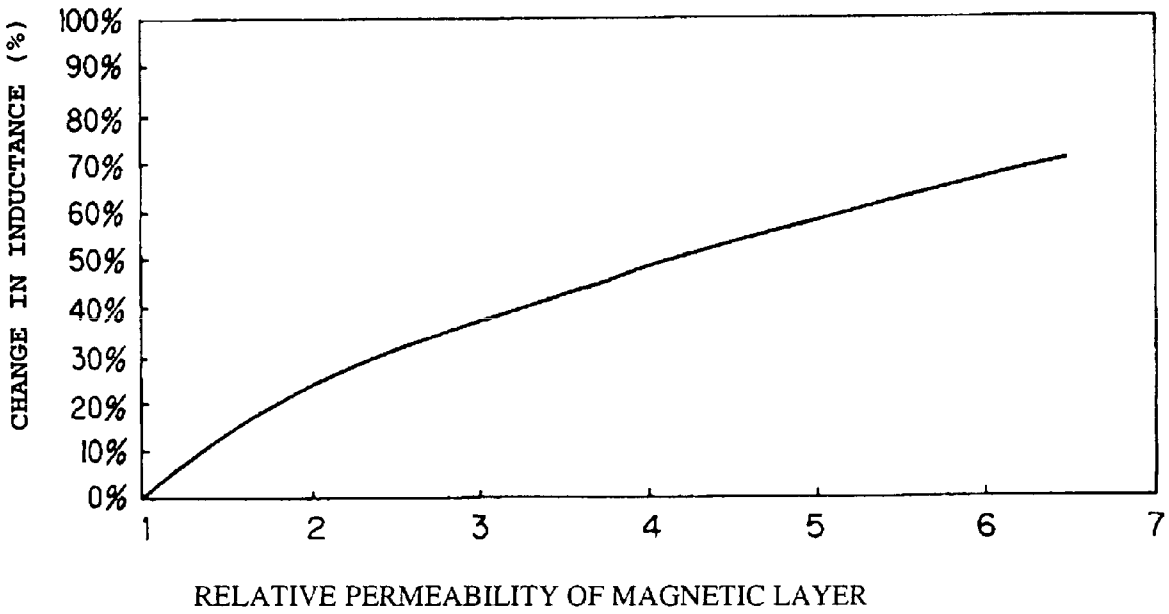
FIG. 4 is a graph showing the relationship between the relative permeability of a magnetic layer and changes in the inductance of a common-mode choke coil (coil device) according to a preferred embodiment of the present invention.

FIG. 4 shows the relationship between the relative permeability of the magnetic layer 20 and changes in inductance. As shown in FIG. 4, when the relative permeability is less than about 2, the rate of change in inductance is excessively large. Therefore, the magnetic layer 20 preferably has a relative permeability of about 2 or more. When the relative permeability exceeds about 7, a large inductance can be obtained but the adhesive characteristics of the magnetic layer 20 are decreased due to a significant increase in the magnetic material (magnetic powder) content, that is, the ratio of the magnetic material to the resin.

The common-mode choke coil of this preferred embodiment preferably has an inductance that is about 1.6 times larger than that of the conventional common-mode choke coil (conventional art 1) shown in 7A and 7B when both the common-mode choke coils have the same planar size, that is, a length of about 1.6 mm and a width of about 1.6 mm, and the magnetic layer has a relative permeability of about 5.

Figure 5:
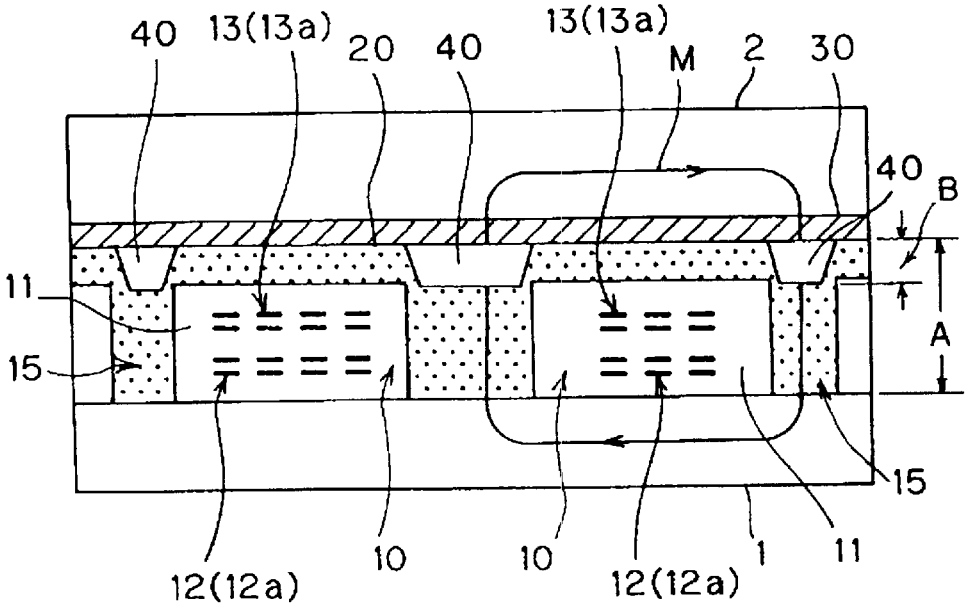
FIG. 5 is a sectional view showing a common-mode choke coil (coil device) according to another preferred embodiment of the present invention.

FIG. 5 is a sectional view showing a common-mode choke coil (coil device) according to another preferred embodiment of the present invention.

In a common-mode choke coil of this preferred embodiment, cavities 40 are disposed at regions that are located above first and second through-holes 14 and 15 and between a magnetic layer 20 and an adhesive layer 30, wherein the first and second through-holes 14 and 15 extend from the upper surface of a laminated body 10 to a first magnetic substrate 1.

The common-mode choke coil of this preferred embodiment has substantially the same configuration as that of the common-mode choke coil of first preferred embodiment. Therefore, the detailed description of the configuration is herein omitted in order to avoid repetition. In FIG. 5, portions having the same reference numerals as those in FIGS. 1 and 2 are substantially the same as those in FIGS. 1 and 2.

In this common-mode choke coil, since the cavities 40 located between the magnetic layer 20 and the adhesive layer 30 project into the magnetic layer 20, the quantity of the magnetic layer 20 is reduced. Therefore, it is possible to reduce the difference in inductance caused by a difference in the relative permeability of the magnetic layer 20 and caused by the condition of the portions of the magnetic layer 20 packed in the through-holes 14 and 15, thereby accurately obtaining the desired inductance and impedance.

The common-mode choke coil of this preferred embodiment can be manufactured by substantially the same method as that of first preferred embodiment.

In this preferred embodiment, the adhesive layer 30 occupies substantially the entire area between the magnetic layer 20 and a second magnetic substrate 2. However, the adhesive layer 30 need not be disposed on substantially the entire area between the magnetic layer 20 and the second magnetic substrate 2. Instead, the adhesive layer 30 may be partially disposed on only a portion of that area. The adhesive layer 30 may be disposed on a region between the magnetic layer 20 and the second magnetic substrate 2 where the cavities 40 are not located. The adhesive layer 30 may be disposed at the peripheries of the cavities 40. Alternatively, for example, the adhesive layer 30 may be disposed on an area corresponding to the periphery of the second magnetic substrate 2, or some portions of the adhesive layer 30 may be arranged so as to form dots.

An example procedure for forming the cavities 40 between the magnetic layer 20 and the adhesive layer 30 is as follows: a magnetic material is applied onto the upper surface of the laminated body 10 and is packed into the first and second through-holes 14 and 15 in the laminated body 10 by a printing method to form the magnetic layer 20 in such a manner that recessed portions remain above the first and second through-holes 14 and 15, and the second magnetic substrate 2 having the adhesive layer 30 thereunder is then joined to the upper surface of the magnetic layer 20 with the adhesive layer 30 located therebetween.

The influence of the cavity depth on changes in inductance is as follows.

Figure 6:
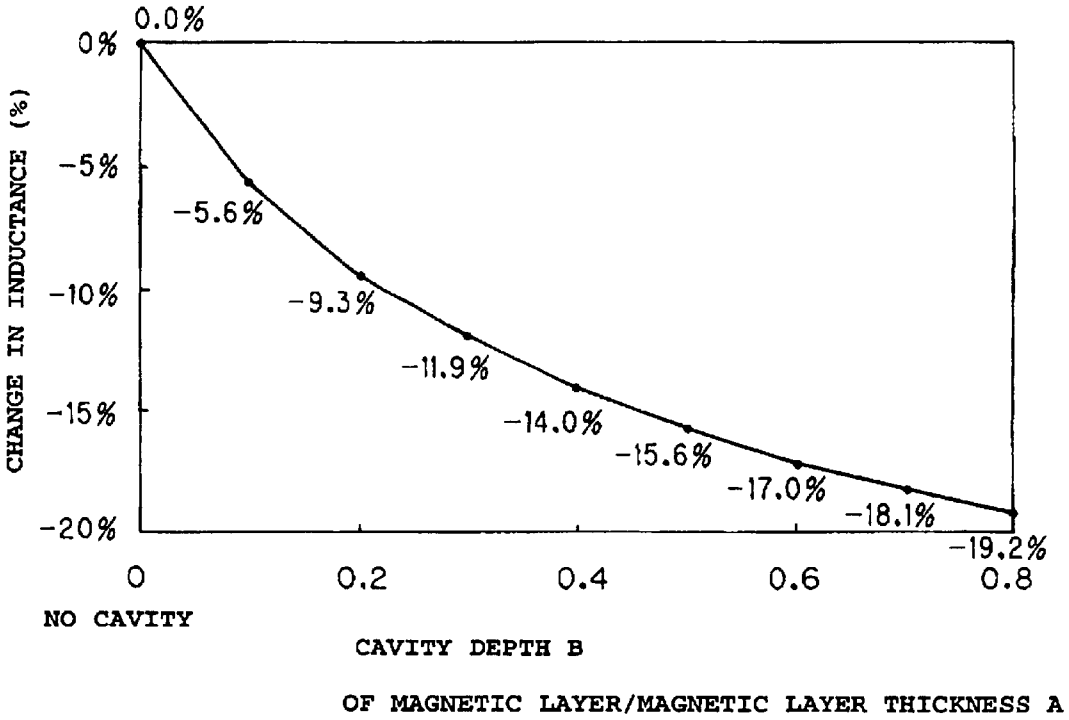
FIG. 6 is a graph showing the relationship between the depth of a cavity and changes in the inductance of a common-mode choke coil (coil device) according to a preferred embodiment of the present invention, wherein the cavity is located between a magnetic layer and an adhesive layer.
Figure 7A:
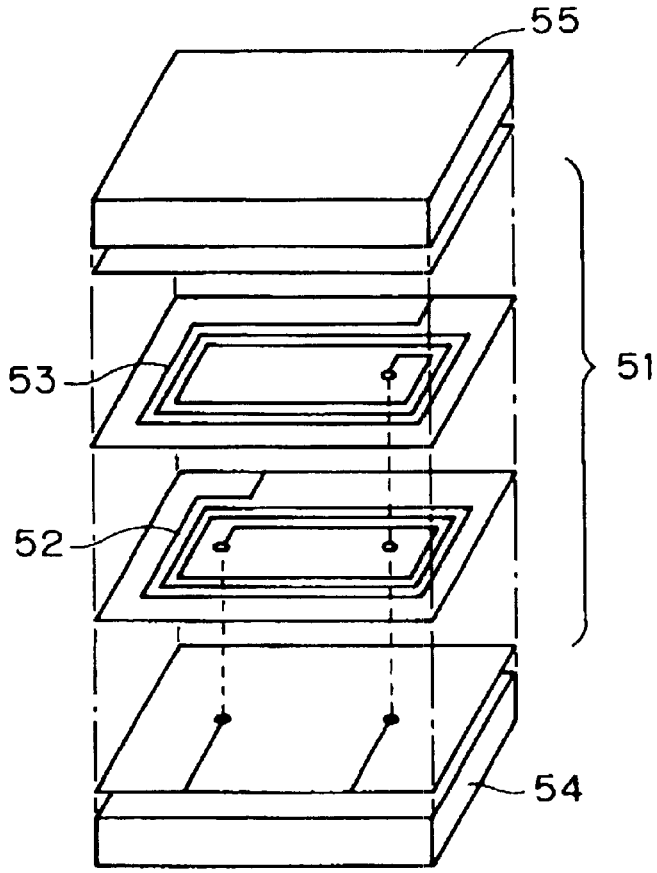
Fig. 7A PRIOR ART
Figure 7B:
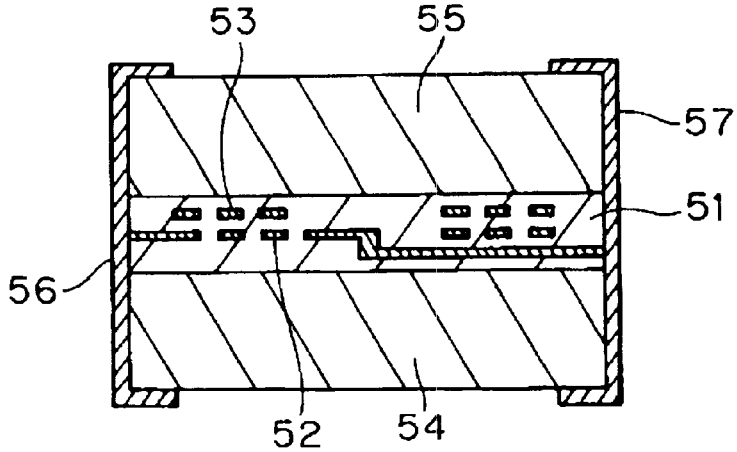
Fig. 7B PRIOR ART
Figure 8:
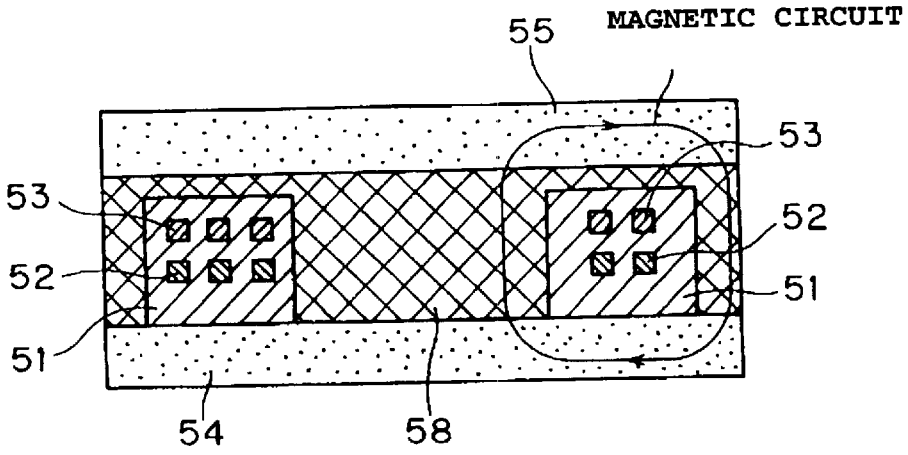
Fig. 8 PRIOR ART
FIG. 8 is a sectional view showing the configuration of another conventional common-mode choke coil (coil device).

FIG. 6 shows the relationship between the ratio B/A and changes in inductance, wherein B represents the depth of the cavities 40 and A represents the thickness of the magnetic layer 20. The thickness of the magnetic layer 20 is a distance between the upper surface of the first magnetic substrate 1 and the lower surface of the adhesive layer 30.

As shown in FIG. 6, when the ratio B/A is less than about 0.2, the rate of change in inductance is too large, which is not preferable. When the ratio B/A is more than about 0.6, a desired inductance cannot efficiently be obtained. Thus, the ratio B/A is preferably about 0.2 to about 0.6.

In the above first and second preferred embodiments, common-mode choke coils are illustrated. However, the present invention is not limited to common-mode choke coils and is applicable to other coil devices, such as transformers.

The present invention is not limited to the above-described first and second preferred embodiments in other respects. Within the scope of the present invention, various modifications and various changes may be performed as follows: materials, the particular shapes of the first and second magnetic substrates, the particular shapes of the coil patterns, the number of coil patterns and insulating layers, positions for connecting the coils, the particular shapes, positions, and number of laminated bodies and the through-holes therein, and the thickness of the nonmagnetic adhesive layer.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A coil device comprising:

a first magnetic substrate;

a laminated body disposed on the first magnetic substrate and having insulating layers, coil patterns, and at least one through-hole;

a magnetic layer covering the upper surface of the laminated body;

an adhesive layer disposed on the magnetic layer; and a second magnetic substrate disposed on the adhesive layer and bonded to the magnetic layer with the adhesive layer;

wherein the insulating layers define an insulator and the coil patterns for defining coils are stacked so that the coils are disposed in the insulator, the at least one through-hole is located at an area where the coils are not situated and extends from the upper surface of the laminated body to the first magnetic substrate, the magnetic layer has at least one portion extending through the at least one through-hole to contact the first magnetic substrate, the adhesive layer is nonmagnetic, and the laminated body is sandwiched between the first and second substrates.

2. The coil device according to claim 1, wherein the coil device defines a common-mode choke coil having a configuration in which a plurality of the coils facing one another with each of the insulating layers disposed therebetween are arranged in the laminated body, and the main portion of each of the coils and each of the insulating layers are stacked alternately.

3. The coil device according to claim 1, wherein the coils are spiral-shaped and have the through-hole at least at substantially the center of each coil.

4. The coil device according to claim 1, wherein at least one of the coils and the insulating layers are made of a photolithographic material.

5. The coil device according to claim 1, wherein the magnetic layer disposed between the first and second magnetic substrates has a relative permeability of about 2 to about 7.

6. The coil device according to claim 1, wherein the distance between the first and second magnetic substrates is about 70 $\mu$m or less, and the adhesive layer has a thickness of about 1 $\mu$m to about 5 $\mu$m.

7. The coil device according to claim 1, wherein the magnetic layer and the adhesive layer have a cavity therebetween and the cavity is located at an area substantially corresponding to the at least one through-hole disposed in the laminated body in plan view.

8. The coil device according to claim 7, wherein the depth of the cavity is about 0.2A to about 0.6A, where A represents the distance between the upper surface of the first magnetic substrate and the lower surface of the adhesive layer, wherein the lower surface is an area where the cavity is not located in the upper surface of the magnetic layer.

9. A coil device comprising:

a first magnetic substrate;

a laminated body disposed on the first magnetic substrate and having insulating layers, coil patterns, and at least one through-hole;

a magnetic layer covering the upper surface of the laminated body;

an adhesive layer disposed on the magnetic layer;

a cavity located at an area between the magnetic layer and the adhesive layer, the area substantially corresponding to the through-hole; and a second magnetic substrate disposed on the adhesive layer and bonded to the magnetic layer with the adhesive layer;

wherein the insulating layers define an insulator and the coil patterns for defining coils are stacked so that the coils are disposed in the insulator, the at least one through-hole is located at substantially the center of the coils and extends from the upper surface of the laminated body to the first magnetic substrate, the magnetic layer has at least one portion extending through the through-hole to contact the first magnetic substrate and has a relative permeability of about 2 to about 7, the adhesive layer is nonmagnetic, and the laminated body is sandwiched between the first and second substrates.

* * * * *